United States Patent [19]

Otsubo et al.

[11] 4,137,874

[45] Feb. 6, 1979

[54] EXHAUST GAS RECIRCULATION CONTROL SYSTEM

[75] Inventors: Kizuku Otsubo, Kokubunji; Ken Nakamura, Kawasaki; Syunich Aoyama, Yokohama, all of Japan

[73] Assignee: Nissan Motor Company, Limited, Japan

[21] Appl. No.: 748,361

[22] Filed: Dec. 7, 1976

[30] Foreign Application Priority Data

Dec. 10, 1975 [JP] Japan ..... 50-146278

[51] Int. Cl.[2] ..... F02M 25/06

[52] U.S. Cl. ..... 123/119 A

[58] Field of Search ..... 123/119 A, 117 A

[56] References Cited

U.S. PATENT DOCUMENTS

| | | | |
|---|---|---|---|
| 3,756,210 | 9/1973 | Kuehl | 123/119 A |
| 3,834,366 | 9/1974 | Kingsbury | 123/119 A |
| 3,901,202 | 8/1975 | Hollis, Jr. et al. | 123/119 A |
| 4,031,871 | 6/1977 | Hamanishi | 123/119 A |
| 4,041,917 | 8/1977 | Suzuki | 123/119 A |

*Primary Examiner*—Wendell E. Burns

*Attorney, Agent, or Firm*—Robert E. Burns; Emmanuel J. Lobato; Bruce L. Adams

[57] ABSTRACT

Engine suction is applied for controlling admission of atmospheric air into a vacuum chamber of an EGR control valve so as to reduce the degree of opening of the EGR control valve during low load running of the engine, and concurrently the vacuum in a venturi of a carburetor is applied for controlling the admission of atmospheric air into the vacuum chamber so as to increase the degree of opening of the EGR control valve during high load running of the engine.

11 Claims, 11 Drawing Figures

EXHAUST GAS RECIRCULATION CONTROL SYSTEM

BACKGROUND OF THE INVENTION

The present invention relates generally to an exhaust gas recirculation (EGR) control system for reducing the production of noxious components such as nitrogen oxides ($NO_x$) in the combustion of an air-fuel mixture in an internal combustion engine by feeding exhaust gas of the engine through an EGR passageway into an intake passageway of the engine in which system an EGR control valve is operated by a vacuum from a port opening into the intake passageway just upstream of a throttle valve in its fully closed position and the vacuum is adjusted by atmospheric air the amount of which is controlled by the pressure of the engine exhaust gas in the EGR passageway, and particularly to an EGR control system of this type which is improved to comprise means for reducing and increasing the amount of the engine exhaust gas fed into the intake passageway during low and high load operations of the engine, respectively.

As is well known in the art, a conventional EGR control system of the above-mentioned type has been constructed in such a manner that during engine low load condition in which it is unnecessary to feed the engine exhaust gas into the intake passageway, an EGR control valve admits an excessive amount of engine exhaust gas into an intake passageway. This has resulted in the degradation of driveability of the engine and an increase in fuel consumption. Furthermore, the conventional EGR control system has been unable to feed a sufficient or necessary amount of engine exhaust gas into the intake passageway owing to a resistance to the flow of the engine exhaust gas in an EGR passageway upstream of the EGR control valve during engine high load condition. This has resulted in an increase in the production of nitrogen oxides.

SUMMARY OF THE INVENTION

It is, therefore, an object of the invention to provide an EGR control system which is so improved that an EGR control valve is operated to reduce the flow of exhaust gas, of an engine, fed into an intake passageway of the engine during enging low load running.

It is a further object of the invention to provide the EGR control system which is so improved that the EGR control valve is further operated to increase the flow of the engine exhaust gas fed into the intake passageway during enging high load running.

BRIEF DESCRIPTION OF THE DRAWINGS

These and other objects and advantages of the invention will become more apparent from the following detailed description taken in conjunction with the accompanying drawings in which.

DESCRIPTION OF THE PREFERRED EMBODIMENTS

Figure 1:
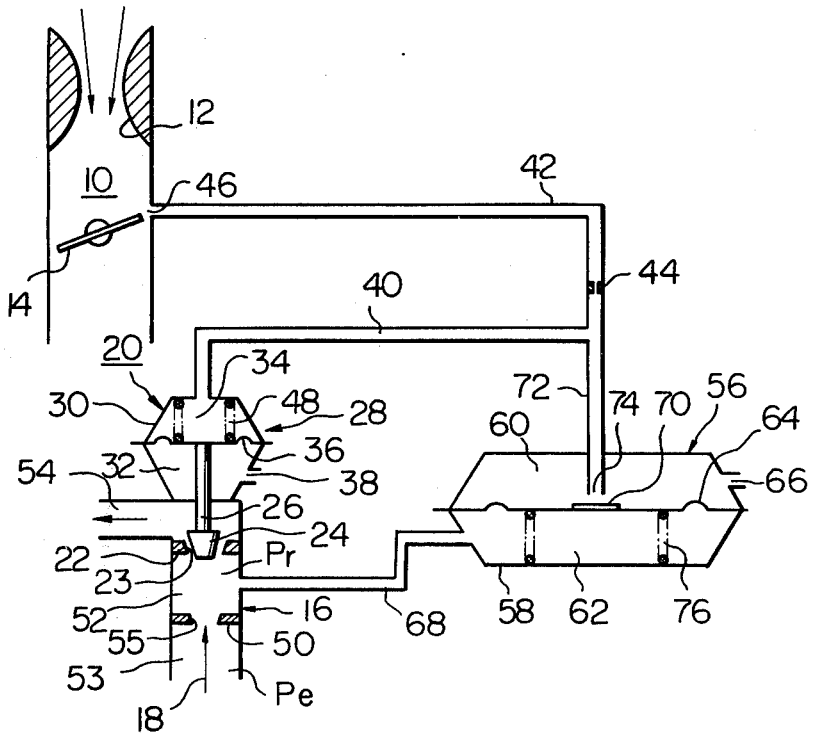
Fig. 1 PRIOR ART
FIG. 1 is a schematic view of an exhample of a prior art EGR control system.

Referring to FIG. 1 of the drawings, there is shown an example of a prior art exhaust gas recirculation (EGR) control system for an internal combustion engine (not shown). The engine includes an intake passageway 10 having a venturi 12 formed therein and a throttle valve 14 rotatably mounted downstream of the venturi 12. The EGR control system comprises an exhaust gas recirculation (EGR) passageway 16 for providing communication between an exhaust system such as an exhaust gas passageway (not shown) of the engine and an intake system such as the intake passageway 10 downstream of the throttle valve 14 to feed exhaust gas of the engine into the intake system. In FIG. 1, the engine exhaust gas flows from the exhaust system to the intake system within the EGR passageway 16 in the direction of the arrows 18. An exhaust gas recirculation (EGR) control valve 20 is disposed in the EGR passageway 16 and controls or meters in accordance with operating conditions of the engine the amount of engine exhaust gas fed into the intake system. The EGR control valve 20 includes a valve seat 22 formed in the EGR passageway 16 and formed therethrough with an aperture or outlet port 23 employed as a path of the flow of engine exhaust gas, a valve head 24 arranged movably relative to the valve seat 22 to vary the cross sectional area of the path of the engine exhaust gas flow and engageable with the valve seat 22 to close the EGR passageway 16, a valve stem 26 extending from the valve head 24, and an operating device such as a diaphragm unit 28 for operating the EGR control valve 20. The diaphragm unit 28 includes a housing 30 having first and second chambers 32 and 34, and a flexible diaphragm 36 separating the chambers 32 and 34 from each other. The first chamber 32 communicates with the atmosphere through an opening 38, while the second chamber 34 communicates with the intake passageway 10 through passages or conduits 40 and 42. The passage 42 is formed therein with an orifice 44 and communicates with a so-called VC hole or port 46 opening into the intake passageway 10 at a point which is located upstream of the throttle valve 14 when the throttle valve 14 is in its substantially fully closed position and downstream of the throttle valve 14 when the throttle valve 14 is opened above a limited small amount. Accordingly, the passage 42 is fed with a vacuum in the intake passageway 10 downstream of the throttle valve 14 only when the throttle valve 14 is opened above a limited small amount. The EGR control valve 20 increases and reduces the flow of the engine exhaust gas, conducted into the intake passageway 10, in response to an increase and a decrease in the vacuum in the second chamber 34. A spring 48 is provided to urge the diaphragm 36 in a direction opposed by the pressure in the chamber 32. The diaphragm 36 is operatively connected to the valve stem 26 of the EGR control valve 20.

The EGR passageway 16 is formed therein with a partition member 50 located upstream of the valve seat 22 and across the EGR passageway 16 in such a manner that a chamber or an intermediate portion 52 is defined between the valve seat 22 and the partition member 50 and divides the EGR passageway 16 into upstream and downstream portions 53 and 54 between which the intermediate portion 52 is interposed. The partition member 50 is formed therethrough with an orifice 55 to provide communication between the EGR passageway 16 upstream of the partition member 50 and the chamber 52. An engine suction vacuum in the intake passageway 10 downstream of the throttle valve 14 acts on the downstream portion 54 to draw the engine exhaust gas therefrom into the intake passageway 10. The pressure in the chamber 52 is assumed to be a negative pressure in this example. Alternatively, the pressure in the chamber 52 may be a positive pressure.

A vacuum regulating device 56 is provided for modulating or adjusting the vacuum in the chamber 34 of the operating device 28 by a back pressure and comprises a housing 58 having first and second chambers 60 and 62, and a flexible diaphragm 64 separating the chambers 60 and 62 from each other. The first chamber 60 communicates with the atmosphere through a vent port 66, while the second chamber 62 communicates with the chamber 52 in the EGR passageway 16 through a passage 68. A vacuum control valve 70 is fixedly secured to the diaphragm 64 in the chamber 60. A passage or conduit 72 communicates at one end with the passages 40 and 42 and opens at free open end 74 into the chamber 60 to admit atmospheric air into the passage 72 and extends toward the valve 70 in such a manner that the valve 70, when is moved toward the passage 72, can engage the free open end 74 of the passage 72 to close it. The vacuum control valve 70 is moved toward and away from the open end 74 to reduce and increase the amount of air admitted into the conduit 72 in response to an increase and a decrease in the pressure in the second chamber 62, respectively. A spring 76 is provided to urge the diaphragm 64 in a direction opposed by the pressure in the chamber 60. When the pressure in the chamber 52 is a positive pressure, the spring 76 is provided to urge the diaphragm 64 in a direction opposed by the pressure in the chamber 62.

In the conventional EGR control system thus far described, the vacuum in the chamber 52 is controlled to a predetermined value and the EGR rate, that is, the rate of the quantity Qe of engine exhaust gas fed into the intake system to the quantity Qm of an air-fuel mixture taken into the engine is controlled to a predetermined value during nearly all operations of the engine, as described in the following.

When the vacuum in the chamber 52 is reduced below a predetermined value, the diaphragm 64 of the vacuum regulating device 56 is moved by the reduced vacuum in the chamber 62 and the force of the spring 76 toward the conduit 72 to reduce the distance between the valve 70 and the conduit 72 or alternatively to engage the valve 70 with the open end 74 of the conduit 72 to close it. By this operation, the vacuum in the conduit 40 and accordingly in the chamber 34 of the EGR control valve 20 is increased to move the diaphragm 36 in a direction in which the degree of opening of the EGR control valve 20 is increased, so that the chamber 52 is more influenced by the engine suction in the downstream portion 54 of the EGR passageway 16. As a result, the vacuum in the chamber 52 and the EGR quantity Qe are increased.

On the contrary, when the vacuum in the chamber 52 is increased above the predetermined value, the diaphragm 64 of the regulating device 56 is moved away from the conduit 72 by the pressure in the chamber 60 opposing to the force of the spring 76 to disengage the valve 70 from the open end 74 of the conduit 72 to open it or alternatively to increase the distance between the valve 70 and the open end 74. By this operation, the vacuum in the chamber 34 of the EGR control valve 20 is reduced to move the diaphragm 36 in a direction in which the degree of opening of the EGR control valve 20 is reduced, so that the chamber 52 is less influenced by the engine suction in the downstream portion 54 of the EGR passageway 16. As a result, the vacuum in the chamber 52 and the EGR quantity Qe are reduced.

Figure 2:
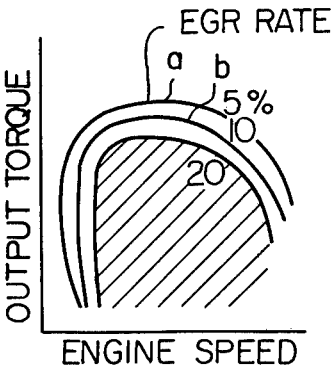
FIG. 2 is a graphic representation of the relationship between the output torque and the speed of an engine and the equi-EGR rate curves of the prior art EGR control system shown in FIG. 1.
Figure 3:
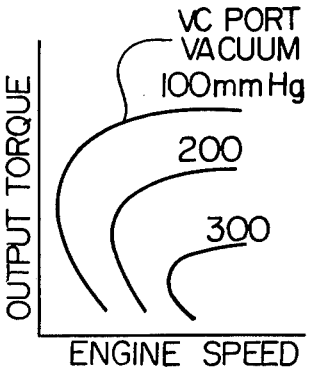
FIG. 3 is a graphic representation of the relationship between the output torque and the speed of the engine and the vacuum in a so-called VC port in an intake passageway of the engine.

Since by the repetition of such operations the vacuum in the chamber 52 is controlled or converged to a predetermined value, the EGR quantity Qe is proportional to a square root of the absolute value Pe of the pressure of engine exhaust gas in the EGR passageway 16 upstream of the partition member 50, that is, to the quantity Qm because the EGR quantity Qe $\alpha \sqrt{Pe-Pr}$ where Pr is the absolute value of the vacuum in the chamber 52. Since $Qm \alpha \sqrt{Pe}$, the EGR rate Qe/Qm is controlled to a predetermined value throughout nearly all operations of the engine. The equi-EGR rate zone having this characteristics is, for example, a portion shown by the hatching in FIG. 2 of the drawings when the vacuum in the VC port 46 has a characteristics as shown in FIG. 3 of the drawings. As seen in FIGS. 2 and 3, the conventional EGR control system has the characteristics irrespective of the vacuum in the chamber 34 when the vacuum in the chamber 34 is above a predetermined level. When the vacuum in the chamber 34 and in the VC port 46 is below the predetermined level as present adjacent to the ordinate and the top of FIG. 3 as during high load and/or low speed operations of the engine, the equi-EGR rates vary with the vacuum in the chamber 34 as shown by the curves a and b present outside the hatching portion in FIG. 2.

As apparent from the description and FIG. 2, since during engine low load operation in which it is unnecessary to effect the EGR the conventional EGR control system effects the EGR at the same EGR rate as that for engine medium and high load operations in which it is necessary to effect the EGR, an excessive amount of engine exhaust gas is fed into the intake passageway to cause the deterioration of operational performance of the engine and an increase in fuel consumption.

The conventional EGR control system has had furthermore a disadvantage that it cannot feed a sufficient or satisfactory amount of engine exhaust gas into the intake passageway due to a resistance to the flow of engine exhaust gas in the EGR passageway 16 upstream of the EGR control valve 20.

Figure 4:
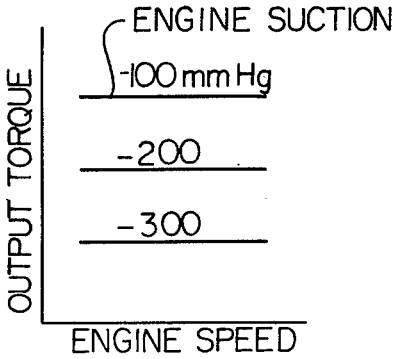
FIG. 4 is a graphic representation of the relationship between the output torque and the speed of the engine and the vacuum in the intake passageway downstream of a throttle valve.
Figure 5:
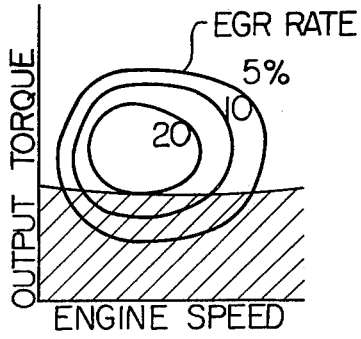
FIG. 5 is a graphic representation of the relationship between the output torque and the speed of the engine and the equi-EGR rate curves of an EGR control system according to the invention.

The invention contemplates to provide an improved EGR control system for an engine which comprises means for causing, by operating a vacuum control valve by the vacuum in an intake passageway downstream of a throttle valve of the engine which vacuum is increased as the load of the engine is reduced as shown in FIG. 4 of the drawings, an EGR control valve to reduce the EGR rate or the EGR quantity Qe during engine low load operation as shown by the hatching portion in FIG. 5 of the drawings.

The invention further contemplates to provide an improved EGR control system for an engine which comprises means for causing, by operating a vacuum control valve by the vacuum in a venturi formed in an intake passageway of the engine, an EGR control valve to increase the EGR rate or EGR quantity Qe during engine high load operation.

Figure 6:
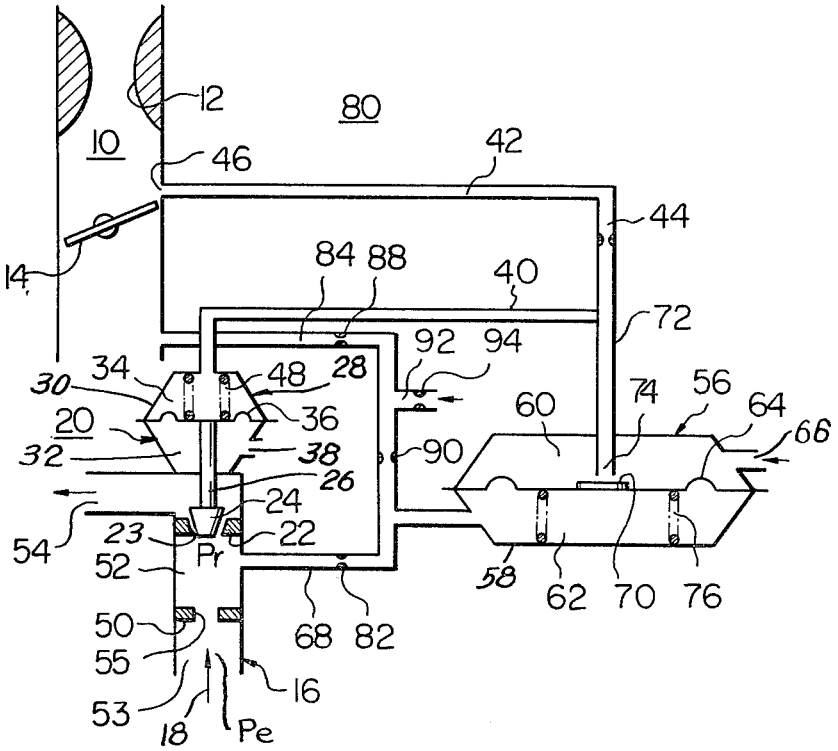
FIG. 6 is a schematic cross sectional view of a first preferred embodiment of an EGR control system according to the invention.

Referring to FIG. 6 of the drawings, there is shown a first embodiment of an EGR control system according to the invention. In FIG. 6, like component elements are designated by the same reference numerals as those used in FIG. 1. The EGR system, generally designated by the reference numeral 80, which is shown in FIG. 6 is characterized in that an orifice 82 is provided in the passage 68 and that a passage or conduit 84 is branched off from the passage 68 between the chamber 62 of the vacuum regulator 56 and the orifice 82 and communicates with the intake passageway 10 downstream of the throttle valve 14 or with an intake manifold 86 of the engine. First and second orifices 88 and 90 are formed in series in the passage 84. The passage 84 between the orifices 88 and 90 communicates with the atmosphere through a passage or conduit 92 and an orifice 94 formed in the passage 92.

The vacuum in the intake passageway 10 downstream of the throttle valve 14 is admitted into the chamber 62 of the vacuum regulator 56 through the conduit 84, the orifices 88 and 90 and the conduit 68 during operations of the engine to increase the vacuum in the chamber 62. Atmospheric air is admitted into the conduit 84 through the orifice 94 and the conduit 92 to reduce the vacuum in the conduit 84 to a necessary or suitable degree. The purpose of admitting atmospheric air into the conduit 84 is to prevent the vacuum in the chamber 62 from being excessively or undesirably increased above a predetermined value by the vacuum fed through the conduit 84. The conduit 92 and the orifices 90 and 94 can be dispensed with to separate the conduit 84 from the atmosphere, if possible.

When the vacuum in the conduit 84 is increased during low load running of the engine, the diaphragm 64 of the vacuum regulator 56 is forced away from the conduit 72 by the atmospheric pressure in the chamber 60. As a result, atmospheric air is admitted into the chamber 34 of the EGR control valve 20 through the open end 74 of the conduit 72. This allows the spring 48 to move the diaphragm 36 into a position in which the EGR control valve 20 reduces the cross sectional area of the path of engine exhaust gas in the EGR passageway 16 to reduce the EGR quantity Qe.

Figure 7:
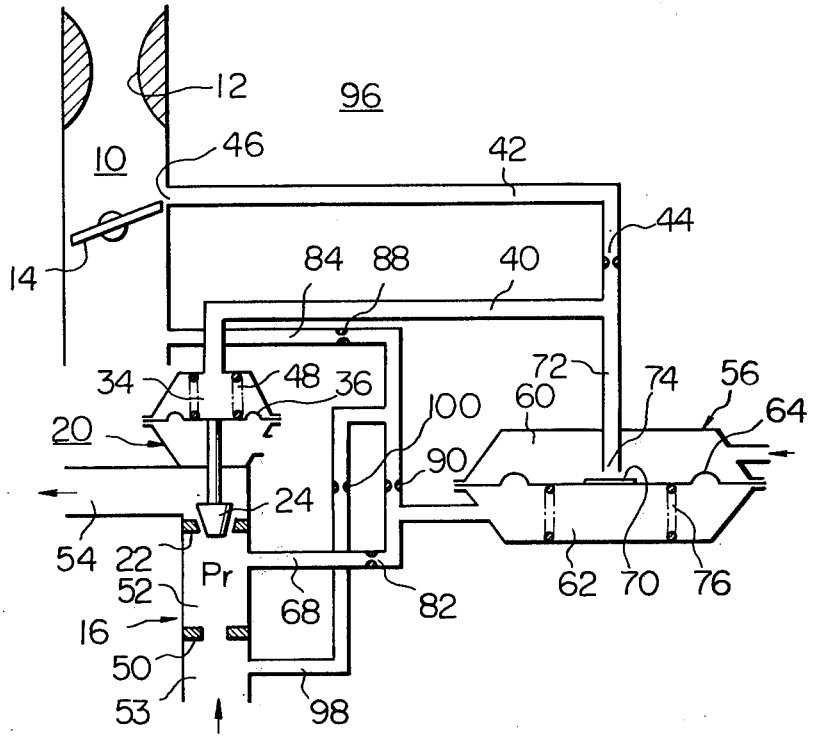
FIG. 7 is a schematic cross sectional view of a modification of the EGR control system shown in FIG. 6.

Referring to FIG. 7 of the drawings, there is shown a modification of the EGR control system shown in FIG. 6. In FIG. 7, like component elements are designated by the same reference numerals as those used in FIG. 6. An EGR system, generally designated by the reference numeral 96, which is shown in FIG. 7 is characterized in that it is provided with a passage 98 providing communication between the passage 84 between the orifices 88 and 90 and the EGR passageway 16 upstream of the partition 50 in lieu of the passage 92 of the EGR system 80 shown in FIG. 6. An orifice 100 is formed in the conduit 98. In this modification, the engine exhaust gas or back pressure is admitted into the conduit 84 to dampen the vacuum in the conduit 84 and to prevent the vacuum in the chamber 62 from being excessively increased. The conduits 98 and 84 serve as a bypass of the EGR passageway 16 through which a small quantity of engine exhaust gas throttled by the orifices 100 and 88 is conducted into the intake passageway 10 downstream of the throttle valve 14 when the EGR passageway 16 is fully closed by the EGR control valve 20 during low load running of the engine so that the output torque of the engine is prevented from being varied by the EGR quantity Qe being abruptly reduced to zero.

Figure 8:
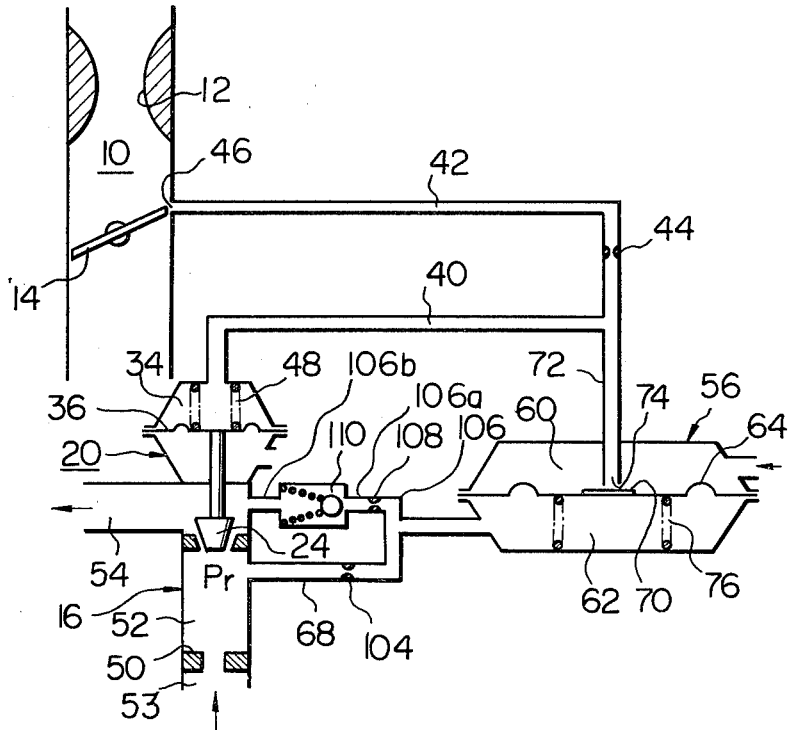
FIG. 8 is a schematic cross sectional view of a second preferred embodiment of an EGR control system according to the invention.

Referring to FIG. 8 of the drawings, there is shown a second embodiment of an EGR control system according to the invention. In FIG. 8, like component elements are designated by the same reference numerals as those used in FIG. 1. The EGR system, generally designated by the reference numeral 102, which is shown in FIG. 8 is characterized in that an orifice 104 is formed in the passage 68 and that a passage or conduit 106 is branched off from the passage 68 between the orifice 104 and the chamber 62 of the vacuum regulator 56 and communicates with the EGR passageway 16 downstream of the EGR control valve 20. Alternatively, the passage 106 may communicate with the intake passageway 10 downstream of the throttle valve 14. An orifice 108 is formed in the passage 106 and a check valve 110 is disposed in the passage 106 between the EGR passageway 16 and the orifice 108. The check valve 110 is opened, when the pressure in the passage **106*a* is above the pressure in the passage 106*b*, to allow fluid flow from the passage 106*a* to the passage 106*b* and is closed, when the pressure in the passage 106*a* is below the pressure in the passage 106*b*, to inhibit fluid flow from the passage 106*b* to the passage 106*a***.

When the vacuum in the intake passageway 10 downstream of the throttle valve 14 is increased above a predetermined value during low load running of the engine, the check valve 110 is opened by the increased vacuum in the intake passageway 10 to communicate the chamber 62 with alternatively the EGR passageway 16 and the intake passageway 10 downstream of the throttle valve 14 through the passage 106. As a result, the vacuum in the chamber 62 is increased by the increased vacuum in the intake passageway 10 fed through the passage 106 to move the diaphragm 64 away from the conduit 72. Accordingly, the degree of opening of the EGR control valve 20 is reduced, for example, to zero to reduce the EGR quantity Qe as described hereinbefore. In this instance, a small quantity of engine exhaust gas is conducted from the chamber 52 of the EGR passageway 16 into alternatively the EGR passageway 16 downstream of the EGR control valve 20 and the intake passageway 10 downstream of the throttle valve 14 through the passages 68 and 106, the orifices 104 and 108 and the check valve 110 to prevent the output torque of the engine from being varied by the EGR quantity Qe being otherwise rapidly reduced to zero.

Figure 9:
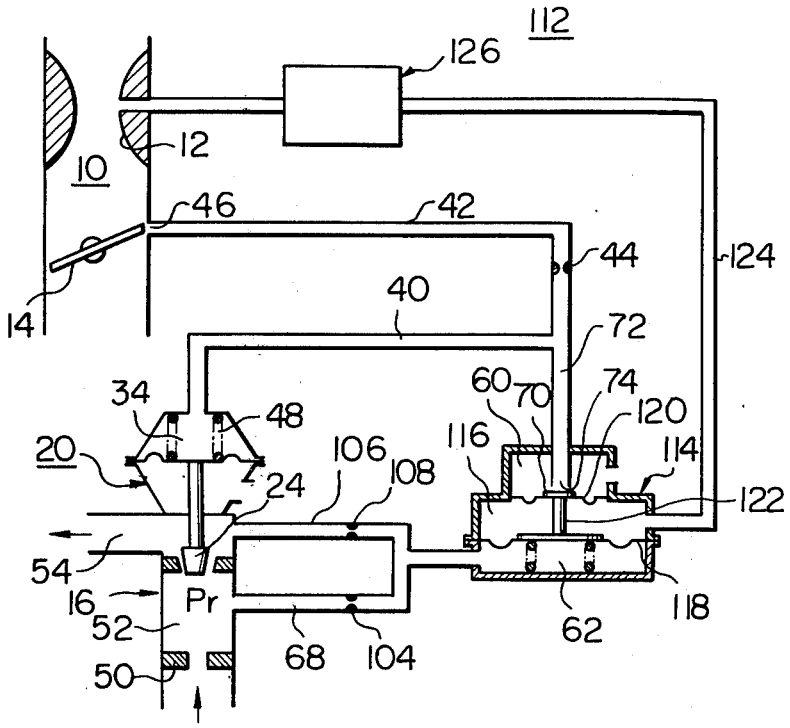
FIG. 9 is a schematic cross sectional view of a third preferred embodiment of an EGR control system according to the invention.

Referring to FIG. 9 of the drawings, there is shown a third embodiment of an EGR control system according to the invention. In FIG. 9, like component elements are designated by the same reference numerals as those use in FIGS. 1 and 8. The EGR system, generally designated by the reference numeral 112, which is shown in FIG. 9 is characterized in that a vacuum regulator 114 has an additional chamber 116 interposed between the chambers 60 and 62. A flexible diaphragm 118 separates the chambers 62 and 116 from each other. A flexible diaphragm 120 separates the chambers 60 and 116 from each other and is connected to the diaphragm 118 through a rod 122. The effective working area of the diaphragm 120 is smaller than that of the diaphragm 118. The valve 70 is fixedly mounted on the diaphragm 120 in the chamber 60. The chamber 116 communicates with the venturi 12 of the intake passageway 10 through a conduit or passage 124. A vacuum amplifying device 126 is disposed in the conduit 124 and amplifies the vacuum in the venturi 12 fed into the conduit 124.

The higher the load of the engine becomes, the greater the pressure differential of the chambers 62 and 116 urging the diaphragm 118 toward the conduit 72 becomes than the pressure differential of the chambers 60 and 116 urging the diaphragm 120 away from the conduit 72 since the vacuum in the intake passageway 10 downstream of the throttle valve 14 approaches the atmospheric pressure to reduce the vacuum in the EGR passageway 16 downstream of the EGR control valve 20 and the vacuum in the venturi 12 is increased to increase the amplified vacuum fed from the vacuum amplifying device 126 and into the chamber 116. Accordingly, the valve 70 is moved toward the conduit 72 to move the EGR control valve 20 in a direction in which the degree of opening of the valve 20 is increased to increase the EGR quantity Qe, similarly as described hereinbefore. This compensates a reduction in the EGR quantity Qe due to an increase in the resistance in the EGR passageway 16 upstream of the partition member 50 to the flow of engine exhaust gas during engine high load operation.

When the engine is running at low loads, the vacuum in the venturi 12 and accordingly the chamber 116 is reduced, while the vacuum in the intake passageway 10 downstream of the throttle valve 14 is increased to increase the vacuum in the EGR passageway 16 downstream of the throttle valve 14 and accordingly in the chamber 62 so that the diaphragm 118 and the valve 70 are moved away from the conduit 72 to reduce the EGR quantity Qe.

Figure 10:
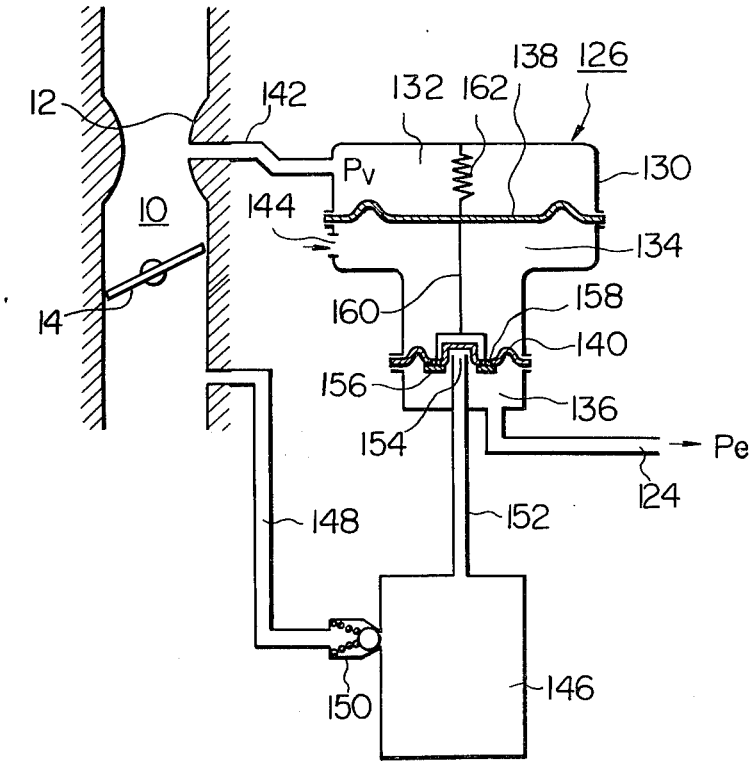
FIG. 10 is a schematic cross sectional view of an example of a vacuum amplifying device forming part of the EGR control system shown in FIG. 9.

Referring to FIG. 10 of the drawings, there is shown an example of a conventional vacuum amplifying device used in FIG. 9. In FIG. 10, like component elements are designated by the same reference numerals as those used in FIG. 9. The vacuum amplifying device 126 comprises a housing 130 having first, second and third chambers 132, 134 and 136 therein. A first flexible diaphragm 138 separates the chamber 132 and 134 from each other. A second flexible diaphragm 140 separates the chambers 134 and 136 from each other. The first chamber 132 communicates with the venturi 12 of the intake passageway 10 through a conduit 142. The second chamber 134 communicates with the atmosphere through a vent port 144. The third chamber 136 communicates with the conduit 124 communicating with the chamber 116 of the vacuum regulator 114. A vacuum tank 146 communicates with the intake passageway 10 downstream of the throttle valve 14 through a conduit 148. A check valve 150 is disposed in the conduit 148 and is opened to allow fluid flow from the vacuum tank 146 to the intake passageway 10 only when the vacuum in the tank 146 is lower than the vacuum in the intake passageway 10. A conduit 152 communicates at one end with the vacuum tank 146 and extends and opens at the other end 154 into the third chamber 136. A hook washer 156 is mounted movably relative to the diaphragm 140 and to open and close the free open end 154 of the conduit 152 and an aperture 158 formed through the second diaphragm 140 and communicating the chambers 134 and 136 with each other. A rod 160 interconnects the diaphragm 138 and the hook washer 156. A tension spring 162 urges the rod 160 away from the conduit 152. By the vacuum amplifying device 128 thus far described, the vacuum Pv in the venturi 12 is amplified or increased to a vacuum Pe as expressed by the following equation.

$$Pe = (S_1/S_2)\,Pv + (F/S_2)$$

where $S_1$ and $S_2$ are the effective working areas of the diaphragms 138 and 140, respectively and F is an initial load of the spring 162.

Figure 11:
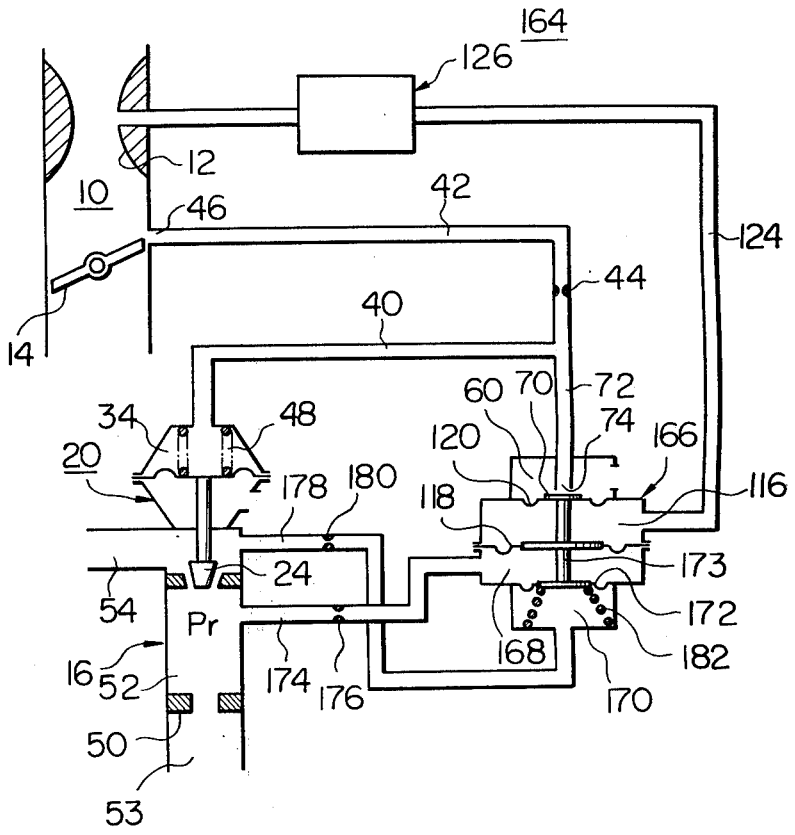
FIG. 11 is a schematic cross sectional view of a modification of the EGR control system shown in FIG. 9.

Referring to FIG. 11 of the drawings, there is shown a modification of the EGR control system 112 shown in FIG. 9. In FIG. 11, like component elements are designated by the same reference numerals as those used in FIG. 9. An EGR control system, generally designated by the reference numeral 164, which is shown in FIG. 11 is characterized in that a vacuum regulator 166 has two chambers 168 and 170 in lieu of the chamber 62 of the vacuum regulator 114 shown in FIG. 9. A flexible diaphragm 172 separates the chambers 168 and 170 from each other and is fixedly connected to the diaphragm 118 through a rod 173. The chamber 168 communicates with the chamber 52 of the EGR passageway 16 through a conduit or passage 174 formed therein with an orifice 176 and is fed with the pressure in the chamber 52. The chamber 170 communicates with the EGR passageway 16 downstream of the EGR control valve 20 through a conduit or passage 178 formed therein with an orifice 180 and is fed with the vacuum in the intake passageway 10 downstream of the throttle valve 14. A spring 182 is provided to urge the diaphragm 172 in a direction opposed by the pressure in the chamber 168.

As the load of the engine is increased, the vacuum in the chamber 168 is reduced and the vacuum in the chamber 116 is increased so that the valve 70 is moved toward the conduit 72. Accordingly, the degree of opening of the EGR control valve 20 is increased to increase the EGR quantity Qe, similarly as described with respect to FIG. 9.

When the engine is running at a low load, the vacuum in the chamber 116 is reduced and the vacuum in the chamber 170 is increased so that the valve 70 is moved away from the conduit 72. Accordingly, the degree of opening of the EGR control valve 20 is reduced to reduce the EGR quantity Qe, similarly as described as to the EGR system of FIG. 9.

It will be appreciated that the invention provides an improved EGR control system comprising means applying an engine suction or a vacuum varying with the engine suction, for controlling admission of atmospheric air into a vacuum chamber of an EGR control valve so as to reduce the degree of opening of the EGR control valve to reduce the EGR rate during engine low load operation, and means applying the vacuum in a venturi of a carburetor or an amplified venturi vacuum, for controlling the admission of atmospheric air into the vacuum chamber so as to increase the degree of opening of the EGR control valve to increase the EGR rate during engine high load operation, so that the operation of the engine is stabilized during engine low load running and the production of nitrogen oxides is reduced during engine high load running.

What is claimed is:

1. An exhaust gas recirculation (EGR) control system for an internal combustion engine, comprising means defining an exhaust gas recirculation (EGR) passageway for conducting exhaust gas of said engine into an intake passageway, of said engine, downstream of a throttle valve, said EGR passageway having upstream and downstream portions and an intermediate portion which is interposed between said upstream and downstream portions and has an orifice providing communication between said upstream and intermediate portions and an outlet port providing communication between said intermediate and downstream portions, an EGR control valve located in said EGR passageway movably relative to said outlet port and including a first flexible diaphragm which has a first fluid chamber on a side thereof and is so operatively connected to said EGR control valve that said EGR control valve varies in accordance with a vacuum in said first fluid chamber the flow of the engine exhaust gas conducted from said outlet port into said downstream portion, first passage means for providing communication between said first fluid chamber and a taking-out port opening into said intake passageway upstream of said throttle valve in its fully closed position to admit into said first fluid chamber the vacuum in said intake passageway, said first passage means having an open end opening into the atmosphere to admit atmospheric air into said first passage means, a vacuum controller including a vacuum control valve located movably relative to said open end of said first passage means, and a second flexible diaphragm which has a second fluid chamber on a side thereof and is so operatively connected to said vacuum control valve that said vaccum control valve varies in accordance with a pressure in said second fluid chamber the amount of atmospheric air admitted into said first passage means, second passage means providing communication between said intermediate portion and said second fluid chamber, and first control means for causing, in response to low load running of said engine, said EGR control valve to reduce the flow of the engine exhaust gas conducted from said outlet port into said downstream portion and first control means comprising third passage means for providing communication between said second fluid chamber and said intake passageway downstream of said throttle valve.

2. An exhaust gas recirculation (EGR) control system in combination with an internal combustion engine including means defining an intake passageway for conducting air into the engine, and a throttle valve disposed in the intake passageway, said EGR control system comprising means defining an exhaust gas recirculation (EGR) passageway communicating with the intake passageway downstream of the throttle valve for conducting exhaust gas of the engine into the intake passageway, said EGR passageway having upstream and downstream portions and an intermediate portion interposed between said upstream and downstream portions;

means defining an orifice for providing communication between said upstream and intermediate portions;

means defining an outlet port for providing communicating between said intermediate and downstream portions;

said downstream portion and the intake passageway downstream of the throttle valve forming a suction vacuum acting passageway on which an engine suction vacuum acts;

an exhaust gas recirculation (EGR) control valve disposed in said EGR passageway for controlling said outlet port;

a first flexible diaphragm;

means defining a first fluid chamber at a side of said first diaphragm;

means defining a first passage for providing communication between said first fluid chamber and the intake passageway upstream of the throttle valve in its substantially fully closed position for admitting a vacuum in the intake passageway into said first fluid chamber;

said first diaphragm being operatively connected to said EGR control valve for causing it to control, in accordance with the vacuum in said first fluid chamber, the flow of the engine exhaust gas passing into said downstream portion through said outlet port;

said first passage defining means having an open end opening into the atmosphere for admitting air into said first passage;

a vacuum control valve for controlling said open end;

operating means for operating said vacuum control valve, said operating means comprising a second flexible diaphragm, and means defining a second fluid chamber at a side of said second diaphragm;

means defining a second passage for providing communication between said second fluid chamber and said intermediate portion for admitting the pressure of fluid therein into said second fluid chamber, said second diaphragm being operatively connected to said vacuum control valve for causing it to control, in accordance with the pressure to fluid in said second fluid chamber, the amount of atmospheric air admitted into said first passage, and first control means for causing, in response to a low load operating condition of the engine, said EGR control valve to reduce the flow of the engine exhaust gas passing into said downstream portion through said outlet port, said operating means having pressure receiving means receiving the pressure in said suction vacuum acting passageway, said first control means comprising means defining a third passage for providing communication between said suction vacuum acting passageway and said pressure receiving means.

3. An EGR control system as claimed in claim 2, in which said pressure receiving means is said second fluid chamber and said third passage provides communication between said second fluid chamber and said intake passageway downstream of said throttle valve.

4. An EGR control system as claimed in claim 3, in which said third passage communicates with the atmosphere through an orifice which admits into said third passage air for preventing the vacuum in said third passage from increasing above a predetermined value.

5. An EGR control system as claimed in claim 3, in which said first control means further comprises means defining a fourth passage for providing communication between said upstream portion and said third passage means said fourth passage being formed therein with means defining an orifice which admits into said third passage the engine exhaust gas for preventing the vacuum in said third passage from increasing above a predetermined value.

6. An EGR control system as claimed in claim 2, in which said pressure receiving means is said second fluid chamber and said third passage provides communication between said downstream portion and said second fluid chamber, and said first control means further comprises a check valve disposed in said third passage and allowing fluid flow from said second fluid chamber to said downstream portion and preventing fluid flow from said downstream portion to said second fluid chamber.

7. An EGR control system as claimed in claim 2, further comprising second control means for causing in response to a high load operating condition of said engine, said EGR control valve to increase the amount of the engine exhaust gas passing through said outlet port into said downstream portion.

8. An EGR control system as claimed in claim 7, in which the engine includes means defining a venturi in the intake passageway and said second control means comprises a third flexible diaphragm having a working area smaller than that of said second diaphragm, means defining a third fluid chamber between said second and third diaphragms, said third diaphragm separating said third fluid chamber from the atmosphere, and means defining a fourth passage for providing communication between said third fluid chamber and the venturi for admitting a vacuum therein into said third fluid chamber said third diaphragm being operatively connected to said vacuum control valve for causing said vacuum valve to further control in accordance with the vacuum in said third fluid chamber, the amount of atmospheric air admitted into said first passage.

9. An EGR control system as claimed in claim 8, in which said second control means further comprises a vacuum amplifying device located in said fourth passage for amplifying said vacuum admitted into said third fluid chamber.

10. An EGR control system as claimed in claim 8, in which said pressure receiving means in said second fluid chamber and said third passage provides communication between said downstream portion and said second fluid chamber.

11. An EGR control system as claimed in claim 8, in which said pressure receiving means comprising a fourth flexible diaphragm, and means defining a fourth fluid chamber, at a side of said fourth diaphragm, said fourth flexible diaphargm connected to said second diaphragm and separating said fourth fluid chamber from said second fluid chamber, said third passage providing communication between said downstream portion and said fourth fluid chamber.

* * * * *